United States Patent [19]

Frank Weyer

[11] Patent Number: 5,072,481

[45] Date of Patent: Dec. 17, 1991

[54] MULTI-SURFACE TOOTHBRUSH

[76] Inventor: Frank Weyer, 81 Toilsome Ave., Norwalk, Conn. 06851

[21] Appl. No.: 437,987

[22] Filed: Nov. 13, 1989

[51] Int. Cl.[5] ..... A46B 9/04

[52] U.S. Cl. ..... 15/167.2; 15/172; 15/DIG. 5

[58] Field of Search ..... 15/167.2, DIG. 5, DIG. 6, 15/172; D4/105, 106

[56] References Cited

U.S. PATENT DOCUMENTS

| | | | |
|---|---|---|---|
| 741,722 | 10/1903 | Ryder et al. | 15/167.2 |
| 1,707,118 | 3/1929 | Goldberg | 15/167.2 |
| 1,830,995 | 11/1931 | Genn | 15/167.2 |
| 1,967,783 | 7/1934 | Rudof | 15/167.2 |
| 2,066,241 | 12/1936 | Trattner et al. | 15/167.2 |
| 3,398,421 | 8/1968 | Rashbaum | 15/167.2 |

FOREIGN PATENT DOCUMENTS

| | | | |
|---|---|---|---|
| 2489119 | 3/1982 | France | 15/167.2 |
| 2600512 | 12/1987 | France | 15/167.1 |
| 6500263 | 12/1965 | Netherlands | 15/167.2 |
| 179403 | 11/1935 | Switzerland | 15/167.2 |
| 19465 | of 1895 | United Kingdom | 15/167.2 |
| 9632 | of 1902 | United Kingdom | 15/167.2 |
| 362332 | 12/1931 | United Kingdom | 15/167.2 |
| 402293 | 11/1933 | United Kingdom | 15/167.2 |
| 493939 | 4/1938 | United Kingdom | 15/167.2 |

*Primary Examiner*—Harvey C. Hornsby
*Assistant Examiner*—Mark Spisich

[57] ABSTRACT

The present invention consists of a toothbrush with multiple tooth cleaning surfaces that allow the simultaneous cleaning of two or more tooth surfaces. In the preferred embodiment, there are three tooth cleaning surfaces, one each for the front, back, and top of the teeth. The tooth cleaning surfaces for the front and the back surfaces of the teeth comprise bristles mounted on surfaces that are movable towards and away from each other to compensate for the varying thicknesses of teeth. The handle of the toothbrush may be pivotably or detachably attached to the head of the toothbrush.

10 Claims, 4 Drawing Sheets

MULTI-SURFACE TOOTHBRUSH

BACKGROUND OF THE INVENTION

Prior art toothbrushes come in a variety of sizes, colors, bristle patterns, and head shapes. But they are all based on the same basic design, comprising a generally flat head containing multiple rows of bristles and a handle fixedly attached to the head. Prior art toothbrushes provide only one tooth cleaning surface, that is the surface made up of the ends of the bristles that contact and clean the teeth. Teeth, however, have three primary surfaces that must be cleaned: their front, back, and top surfaces. Prior art toothbrushes can clean only one surface at a time. To clean all three surfaces, three different brush positions, and therefore three different brush strokes, are required. Brushing teeth with prior art toothbrushes is therefore a time consuming process.

SUMMARY OF THE INVENTION

The present invention consists of a toothbrush having a head with multiple, bristle-covered toothcleaning surfaces that allow the simultaneous cleaning of two or more tooth surfaces. In the preferred embodiment, there are three primary tooth cleaning surfaces, allowing the simultaneous cleaning of the front, top and back surfaces of a row of teeth. The handle of the toothbrush of the present invention may be fixedly attached to the head, or preferably is pivotably attached to allow brushing of an entire row of teeth without having to remove and change the position of the toothbrush. In the preferred embodiment, the bristled tooth cleaning surfaces for the front and back surfaces of the teeth are flexible and biased towards each other to allow the brush to be used on teeth of varying width, and to insure continued contact between the bristles and the front and back surfaces of the teeth even after the bristles lose some of their resiliency with continued use.

DETAILED DESCRIPTION OF THE INVENTION

Figure 1:
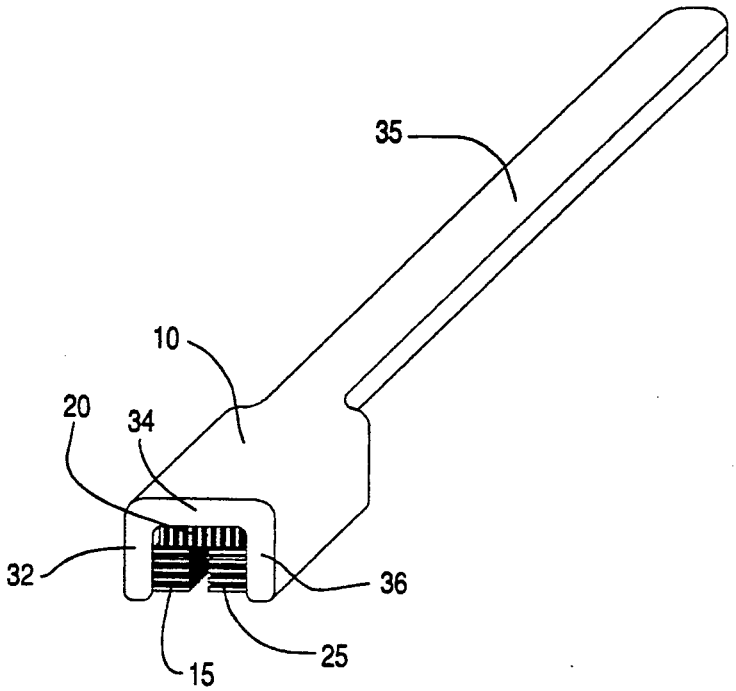
FIG. 1 is a perspective view of a first embodiment of the toothbrush of the present invention.

The first embodiment of the toothbrush of the present invention is shown in FIG. 1. It comprises a head 10 and an integrally formed handle 35. Head 10 has a generally U-shaped cross section. Bristles are disposed along the inside surfaces of arms 32 and 36, and base 34, of the "U", forming tooth cleaning surfaces 15, 20 and 25.

These surfaces allow the simultaneous cleaning of the front, top and back of the teeth. The bristles may also extend around the ends of arms 32 and 36 to provide for the cleaning and stimulation of the gums. The bristles are preferably nylon, as are well known in the art. They may have any desired size and stiffness, and may be arranged in a variety of patterns. Because teeth vary in thickness from the relatively thin front teeth to the relatively thick back molars, preferably the bristles are long enough to simultaneously contact the front, top and back surfaces of the thin front teeth, but flexible enough to flex sufficiently to allow the thick molars to pass between opposing tooth cleaning surfaces 15 and 25.

Figure 2A:
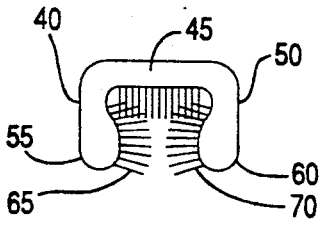
FIG. 2A, FIG. 2B and FIG. 2C are front views of a second embodiment of the toothbrush of the present invention.
Figure 2B:
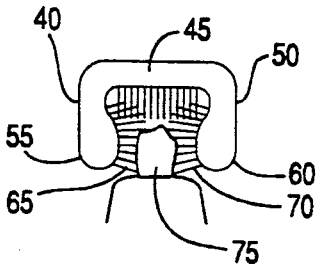
Figure 2C:
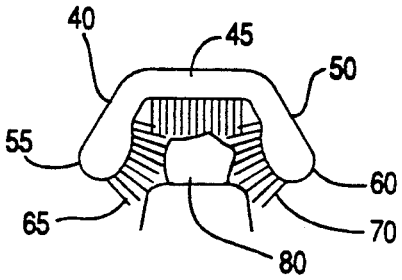

An alternative way of accounting for the difference in tooth thicknesses is shown in FIGS. 2A, 2B and 2C. In the embodiment of the head of the toothbrush shown in these figures, the side arms 40 and 50 of head 45 are flexible, such that the ends 55 and 60 can move outwards, away from each other, to a limited degree. FIG. 2A shows the ends 55 and 60 at their rest positions. In this position, ends 55 and 60 are biased towards each other such that their bristles 65 and 70 almost touch. FIG. 2B shows the head 45 positioned over a narrow front tooth 75. The ends 55 and 60 are flexed outwards a small extent to make room between bristles 65 and 70 for tooth 75. FIG. 2C shows the head 45 positioned over a wide molar 80. The pressure of tooth 80 against the ends of bristles 65 and 70 causes ends 55 and 60 to flex outwards to a greater extent than as in FIG. 2B.

Figure 3:
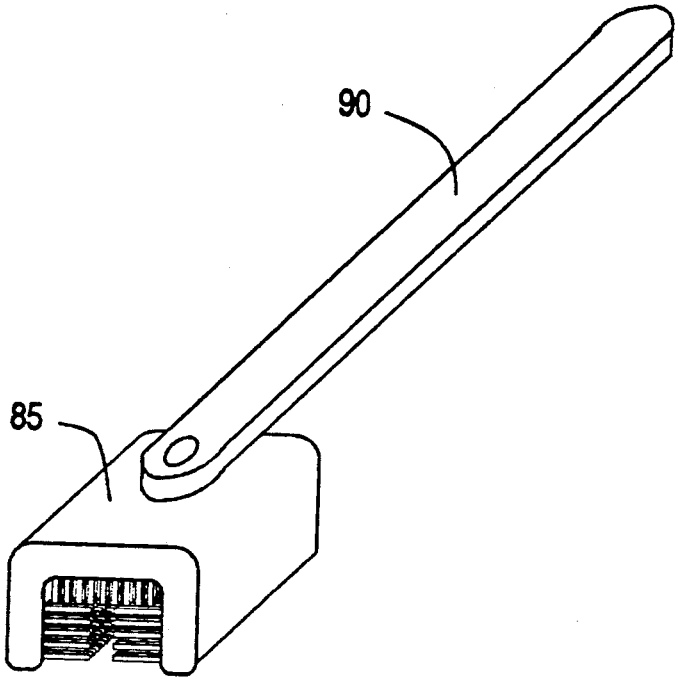
FIG. 3 is a perspective view of an embodiment of the present invention incorporating a pivoting handle.

A further embodiment of the present invention is shown in FIG. 3. In this embodiment, handle 90 is pivotally attached to head 85. The pivoting handle allows the head 85 to slide along an entire row of teeth without having to remove the toothbrush from the mouth to change its position when moving the toothbrush from one end of a row of teeth to the other, as is required with a fixed handle. Handle 90 may also be detacheable, to allow head 85 to be replaceable. Handle 90 may also be attached to head 85 by a ball and socket or similar joint, allowing additional degrees of freedom of movement.

Figure 4:
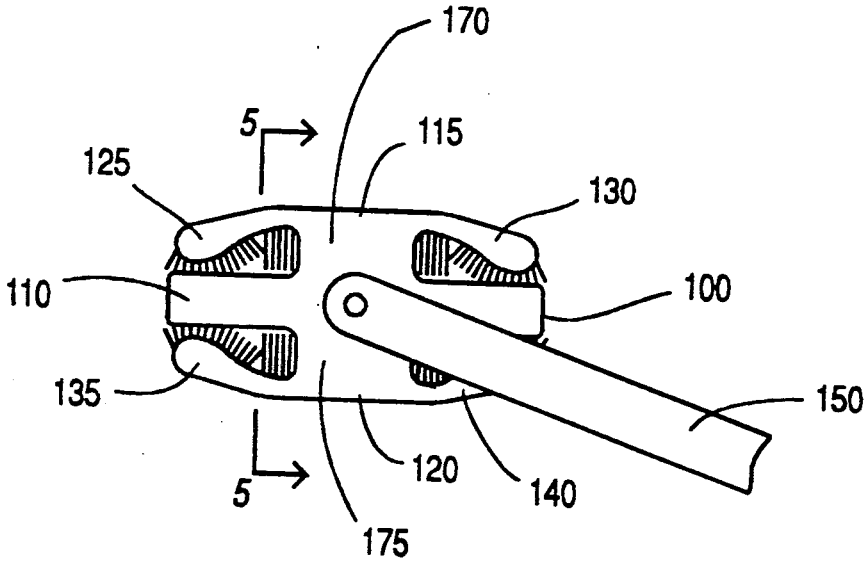
FIG. 4 is a top view of the head of a further embodiment of the toothbrush of the present invention.
Figure 5:
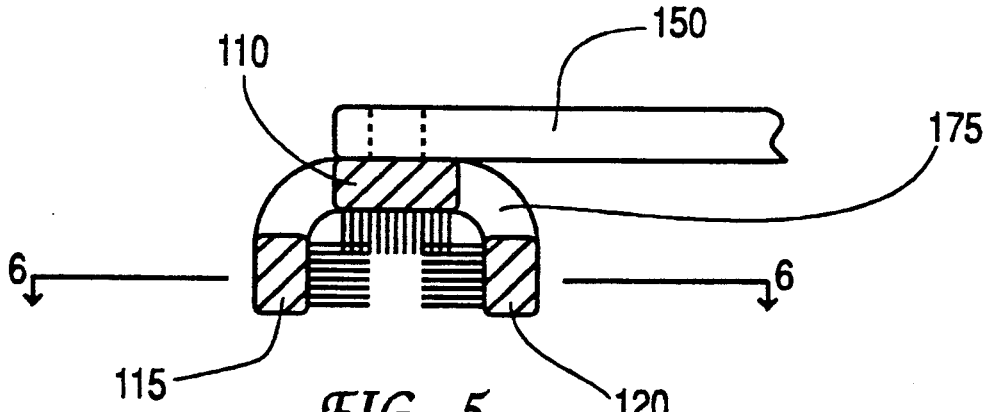
FIG. 5 is a front sectional view of the head of the toothbrush depicted in FIG. 4.
Figure 6:
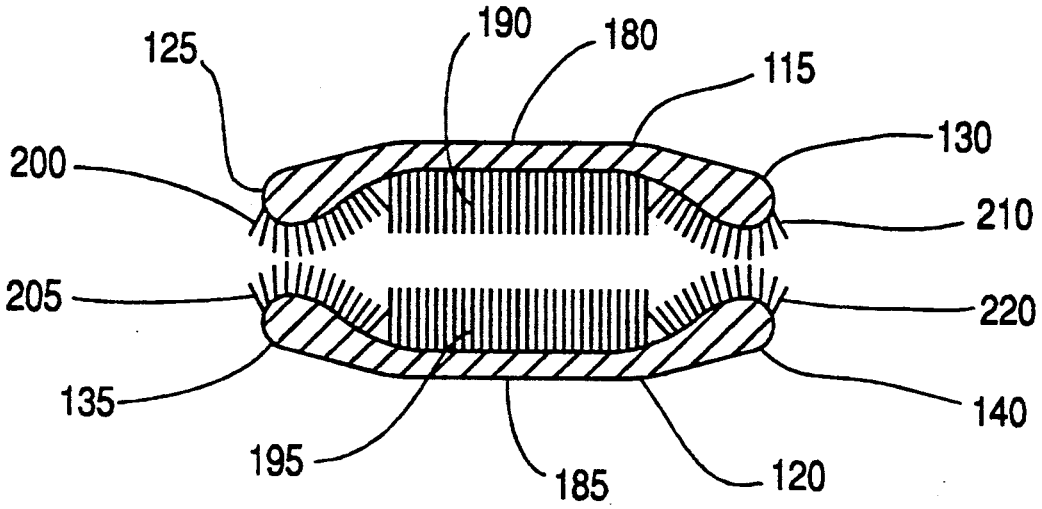
FIG. 6 is a top sectional view of the head of the toothbrush depicted in FIGS. 4 and 5.

The preferred embodiment of the toothbrush of the present invention is shown in FIGS. 4, 5 and 6. As can be seen in FIG. 4, this embodiment is comprised of a head 100 pivotably attached to a handle 150. Head 100 may, but need not be, detachable from handle 150. Head 100, like the head of the previous embodiments, comprises three bristled tooth cleaning surfaces for the front, top and back of the teeth. The tooth cleaning surfaces consist of bristles mounted on generally longitudinally shaped members, indicated in FIGS. 4 and 5 as items 110, 115 and 120 for the top, back and front members, respectively. Bridge sections 170 and 175 connect back and front members 115 and 120 to top member 110, to which handle 150 is also pivotably attached.

Top member 110 is generally flat and fairly stiff, while the ends 125 and 130, and 135 and 140, of back and front members 115 and 120, respectively, are flexible and curved as shown in FIGS. 4 and 6. Ends 125 and 135, and 130 and 140, are normally disposed towards each other, but flex outward when a thick molar passes in between them. As shown in FIG. 6, bristles 190 and 195 mounted on the center sections 180 and 185 of back and front members 115 and 120, respectively, are relatively long and flexible, while bristles 200, 205, 210 and 220 mounted on ends 125, 135, 130 and 140, respectively, of back and front members 115 and 120 are shorter and stiffer.

Figure 7:
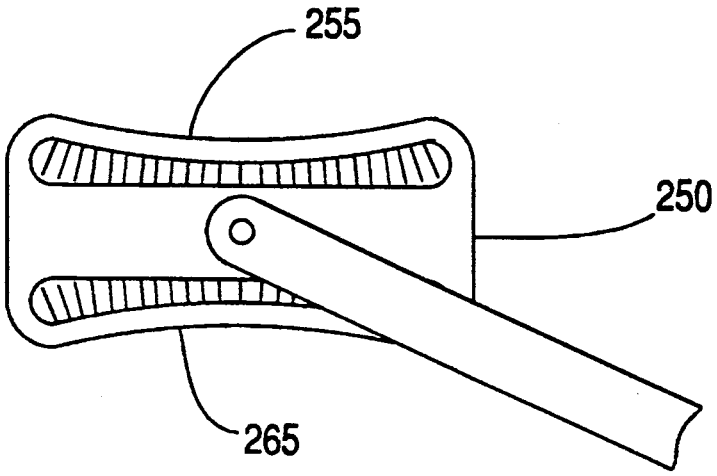
FIG. 7 is a top view of a further embodiment of the head of the toothbrush of the present invention.
Figure 8:
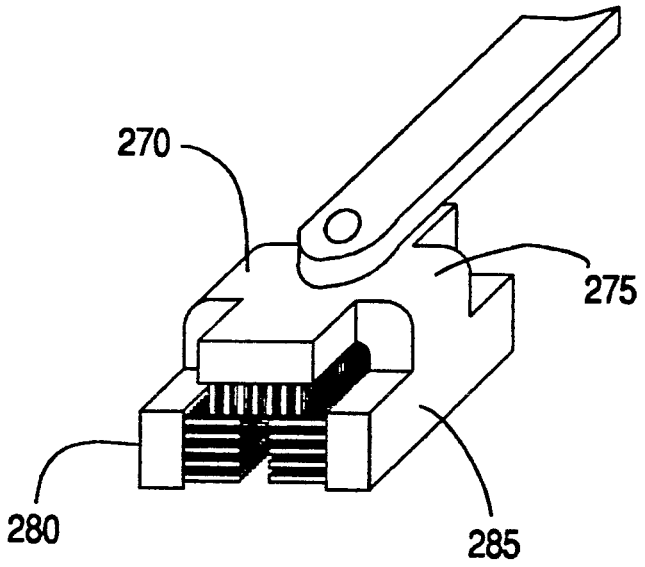
FIG. 8 is a perspective view of a further embodiment of the toothbrush of the present invention.

Other variations of the head of the toothbrush of the present invention are shown in FIGS. 7 and 8. In the embodiment shown in FIG. 7, the center sections of back and front members 255 and 265, rather than the ends, are flexibly movable. In the embodiment shown in FIG. 8, bridge sections 270 and 275 are flexible, allowing entire front and back members 280 and 285 to move towards and away from each other according to the thickness of the teeth in between. Front and back members 280 and 285 may also have convex rather than flat bristled surfaces to ensure that the bristles remain orthogonal to the front and back tooth surfaces as the separation between the front and back members 280 and 285 changes.

Figure 9:
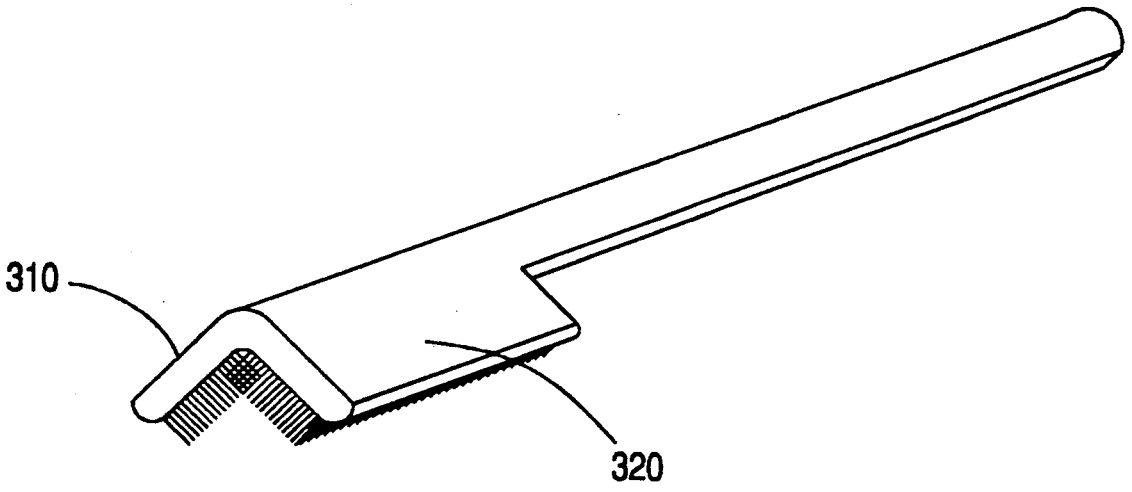
FIG. 9 is a perspective view of a further embodiment of the toothbrush of the present invention.

FIG. 9 shows a further embodiment of the present invention that has two, generally perpendicular, tooth cleaning surfaces 310 and 320 rather than three.

Other embodiments incorporating the inventive features of the present invention will be apparent to those skilled in the art.

I claim:

1. A toothbrush for brushing plural tooth surfaces comprising:

a brush head comprising an elongated top brush having first and second opposite sides, a top and a bottom; a handle mounted to said top and a plurality of bristles fixed to said bottom and extending outwardly therefrom; an elongated first side brush resiliently fixed to the first side of said top brush by a first bridge section and an elongated second brush resiliently fixed to the second side of said top brush by a second bridge section; each of said side brushes being generally flexible;

each of said first and second side brushes being fixed to said top brush so as to extend generally normal to said top brush and extending outwardly from the bottom of said top brush; said first and second side brushes each having a side adjacent the bottom of the top brush and wherein the side of each side brush faces the other of the side brushes and wherein a plurality of bristles are fixed to the side of each side brush and extending outwardly therefrom; the top brush, first side brush and second side brush cooperatively define a generally U-shaped channel to accomodate a row of teeth;

said first side brush and second side brush each further comprising a straight central portion having opposite ends and wherein the straight central portion of the side brushes are generally parallel to the top brush; first and second free end portions fixed to the opposite ends of each central portion such that the first free end of each side brush is opposite the first free end of the other side brush and the second free end of each side brush is opposite the second free end of the other side brush; said free end portions of each side brush being curved toward the opposing free end portion of the other side brush; the bristles of said side brushes being affixed to both the central portions and free end portions;

said straight central portions of said side brushes being separated by a first distance and the opposing free ends of the side brushes being separated by a second distance, said first distance being greater than said second distance;

such that when the head is applied to a row of teeth such that teeth are disposed in said channel, said first distance is adjusted to adapt to varying diameters of teeth between the ends of the straight central portions of the side brushes and said second distance is adjusted to adapt to varying diameters of teeth between the free ends of the first and second side brushes; said adjusting of the first distance being possible by virtue of the resilient connection between the side brushes and top brush and said adjusting of the second distance being possible by virtue of the flexible nature of the side brushes themselves.

2. The toothbrush of claim 1 wherein the bristles affixed to the straight central portions of the side brushes are of a first length and the bristles affixed to the free end portions of the side brushes are of a second length and further wherein the first length is greater than said second length.

3. The toothbrush of claim 1 wherein the bristles affixed to the straight central portions of the side brushes are of a first stiffness and the bristles affixed to the free end portions of the side brushes are of a second stiffness and further wherein said first stiffness is less than said second stiffness.

4. The toothbrush of claim 1 wherein said handle is pivotally mounted to the top brush.

5. The toothbrush of claim 1 wherein said handle is removably mounted to the top brush.

6. A toothbrush for brushing plural tooth surfaces comprising:

a brush head comprising an elongated top brush having first and second opposite sides, a top and a bottom; a handle mounted to said top and a plurality of bristles fixed to said bottom and extending outwardly therefrom; an elongated first side brush fixed to the first side of said top brush by a first bridge section and an elongated second brush fixed to the second side of said top brush by a second bridge section; each of said side brushes being generally flexible;

each of said first and second side brushes being fixed to said top brush so as to extend generally normal to said top brush and extending outwardly from the bottom of said top brush; said first and second side brushes each having a side adjacent the bottom of the top brush and wherein the side of each side brush faces the other of the side brushes and wherein a plurality of bristles are fixed to the side of each side brush and extending outwardly therefrom; the top brush, first side brush and second side brush cooperatively define a generally U-shaped channel to accomodate a row of teeth;

said first side brush and second side brush each further comprising a straight central portion having opposite ends and wherein the straight central portion of the side brushes are generally parallel to the top brush; first and second free end portions fixed to the opposite ends of each central portion such that the first free end of each side brush is opposite the first free end of the other side brush and the second free end of each side brush is opposite the second free end of the other side brush; said free end portions of each side brush being curved toward the opposing free end portion of the other side brush; the bristles of said side brushes being affixed to both the central portions and free end portions;

said straight central portions of said side brushes being separated by a first distance and the opposing free ends of the side brushes being separated by a second distance, said first distance being greater than said second distance;

such that when the head is applied to a row of teeth such that teeth are disposed in said channel, said second distance is adjusted to adapt to varying diameters of teeth between the free ends of the first and second side brushes; said adjusting of the second distance being possible by virtue of the flexible nature of the side brushes.

7. The toothbrush of claim 6 wherein the bristles affixed to the straight central portions of the side brushes are of a first length and the bristles affixed to the free end portions of the side brushes are of a second length and further wherein the first length is greater than said second length.

8. The toothbrush of claim 6 wherein the bristles affixed to the straight central portions of the side brushes are of a first stiffness and the bristles affixed to the free end portions of the side brushes are of a second stiffness and further wherein said first stiffness is less than said second stiffness.

9. The toothbrush of claim 6 wherein said handle is pivotally mounted to the top brush.

10. The toothbrush of claim 6 wherein said handle is removably mounted to the top brush.

* * * * *